US005502906A

United States Patent [19]

Yamawaki

[11] Patent Number: 5,502,906

[45] Date of Patent: Apr. 2, 1996

[54] CLOTH FIXING FRAME WITH CORNER AND CLOTH FIXING MEMBERS

[75] Inventor: Shigehiro Yamawaki, Moriguchi, Japan

[73] Assignee: Ebaris Co., Ltd., Osaka, Japan

[21] Appl. No.: 314,821

[22] Filed: Sep. 29, 1994

[30] Foreign Application Priority Data

Oct. 5, 1993 [JP] Japan ..... 5-249080
Jun. 23, 1994 [JP] Japan ..... 6-141773

[51] Int. Cl.[6] ..... D06C 3/08; B44D 3/18

[52] U.S. Cl. ..... 38/102; 38/102.3; 38/102.91; 160/381; 160/398; 160/404

[58] Field of Search ..... 38/102, 102.1, 38/102.3, 102.91, 102.7; 160/378, 391, 382, 395, 398, 381, 404, 374.1, 392; 101/127.1; 242/67.1; 248/466, 473, 475.1, 441.1, 447.1, 447.2

[56] References Cited

U.S. PATENT DOCUMENTS

| | | | |
|---|---|---|---|
| 1,895,309 | 1/1933 | Boomershine | 38/102.91 |
| 2,073,037 | 3/1937 | Weber | 160/404 |
| 2,504,602 | 4/1950 | Steingruber | 160/381 |
| 2,989,788 | 6/1961 | Kessler | 160/381 X |
| 3,494,409 | 2/1970 | Prechtl et al. | 160/395 X |
| 3,559,316 | 2/1971 | Galper | 38/102.91 |
| 3,830,033 | 8/1974 | Gahler | 160/391 X |
| 3,978,905 | 9/1976 | De Lama et al. | 38/102.91 X |
| 4,255,886 | 3/1981 | Klarman | 38/102.3 |
| 4,452,138 | 6/1984 | Bubley et al. | 160/381 X |
| 5,301,737 | 4/1994 | Martin | 160/395 X |

FOREIGN PATENT DOCUMENTS

| | | | |
|---|---|---|---|
| 1475147 | 4/1966 | France | 160/378 |
| 2081651 | 2/1982 | United Kingdom | 160/378 |
| 2020535 | 11/1992 | WIPO | 38/102.91 |

*Primary Examiner*—Ismael Izaguirre
*Attorney, Agent, or Firm*—Koda and Androlia

[57] ABSTRACT

A rectangular cloth fixing frame for use in painting or embroidery. The frame including a plurality of frame portions. Each frame portion including a surface projection near an outer periphery of a front surface thereof and a fixing fitting groove on the outer peripheral end surface. Corner members connect the frame portions so as to form the cloth fixing frame. A cloth such as a canvas of a desired shape is spread over the rectangular frame, a plurality of fixing elements are driven through the canvas and into the fixing fitting groove to thereby fix the canvas to the rectangular frame under tension.

4 Claims, 23 Drawing Sheets

CLOTH FIXING FRAME WITH CORNER AND CLOTH FIXING MEMBERS

BACKGROUND OF THE INVENTION

1. Field of the Invention

The present invention relates to a cloth fixing frame which is used for painting, embroidery, wall decoration and the like.

2. Prior Art

As a cloth fixing frame of this type, there has been a canvas fixing frame to be used for oil painting. This canvas fixing frame has been made in such a manner that as shown in FIGS. 42 and 44, a frame 70 is formed by combining a plurality of wooden frame-pieces, a cloth 72 such as a hemp cloth is placed on the front surface of the frame 70 and after fixing together the frame-pieces by driving nails 73 into the outer periphery of the frame, the cloth is fixed to the frame. By the way, reference numeral 74 designates a tilted portion of the front surface of the frame and reference numeral 75 designates a surface projection forming the edge of the frame.

However, although, with the recent trend of thinning the picture frame in general, it has been demanded to likewise thin the canvas frame, there has been a problem that when the canvas frame is made of wooden material, it is liable to crack easily.

Further, as shown in FIG. 44, it is not easy to drive the nails 73 in straight line but if they are not driven so, they look unsightly. Moreover, when the frame-pieces are made thin, some of the nails 73 tend to lie close to the front side of the frame so that the peripheral portion of the cloth 72 tends to become buldged and the flatness of the clothe 72 is hardly maintained.

Accordingly, an object of the present invention is to provide a cloth fixing frame capable of securing the flatness of the cloth and reducing the thickness thereof.

SUMMARY OF THE INVENTION

The cloth fixing frame according to the present invention includes surface projection extending along the outer periphery of the front surface of the frame and a fixing means fitting groove formed along the outer peripheral end surface of the frame.

According to a first aspect of the present invention, a cloth such as can be fixed with ease in such a manner that the cloth is placed on the front surface of the frame, the fixing means are pierced into the cloth at the fixing means fitting groove along the outer peripheral end surface of the frame. Further, as the fixing means which are large in number are arranged in a straight line along the fixing means fitting groove, it is possible to prevent the cloth from becoming bulged due to the position of the fixing means such as nails driven into the outer end face of the frame so that the flatness of the cloth can be secured and the cloth fixing frame can be thinned.

According to a second aspect of the present invention, the frame is provided with a pluralty of extrusion-molded frame-pieces for forming the frame, corner members for connecting these frame-pieces and fixing means for fixing a cloth to be fixed to the front surface of the frame. Each of the frame-pieces is provided with a U-shaped groove formed along the outer peripheral end surface thereof, a cloth fixing projection at the front side of the U-shaped groove and a hollow portion for allowing one end of each of the corner members to be fitted therein. The fixing means comprises a leg capable of being driven into the U-shaped groove through the cloth and a head for pressing the cloth against the outer peripheral end surface of the frame so as to fix the cloth to the frame.

According to this type of cloth fixing frame, the frame is formed in such a manner that both ends of the corner members are fitted into the hollow portions of the adjoining frame-pieces thereby coupling the frame-pieces, the cloth is placed on the front surface of the frame and the fixing means is driven into the U-shaped groove through the cloth while drawing the periphery of the cloth toward the rear surface of the frame thereby fixing the cloth to the frame. In this case, since the leg of the fixing means is pierced through the cloth and the portion of the cloth drawn over the cloth fixing projection of the frame-piece is pressed by the head of the fixing means, the cloth is spread over the front surface of the frame under tension. Further, since the frame-piece is extrusion-molded with a metallic or resin material, the frame is easy to manufacture and can be thinned.

According to a third aspect of the present invention, the opposing inner wall surfaces of the above-mentioned U-shaped groove are corrugated so that the leg of the fixing means come into frictional contact with the inner wall surfaces of the U-shaped groove thereby causing the fixing means to be securely fitted into the groove.

According to a fourth aspect of the present invention, each of the frame-pieces for forming the frame has two hollow portions arranged parallelly in the direction of the width thereof and is provided with a plurality of through-holes drilled in the side surfaces near both ends thereof so as to communicate with the hollow portions, and the corner members are provided to correspond in number to the hollow portions and each of the members is provided with a plurality of screw-holes in alignment with the above-mentioned through-holes, respectively. Further, each of the corner members is pressed against, and fixed to, the front end of each of the hollow portions by means of bridging screws with the top end of each bridging screw abutting against the inner wall surface of the hollow portion.

According to this type of cloth fixing frame, the corner members can be fixed securely with the bridging screws from the front side of each frame-piece so that the strength of the frame can be maintained and the frame-pieces can be assembled with ease. Further, when the bridging screw is fitted into the screw hole via the through-hole until the top end of the bridging screw abuts against the inner wall surface of the hollow portion and then the bridging screw is further driven forward, the corner member can be clamped to the front end of the hollow portion. Consequently, the corner member can be fixed without allowing the rear end of the bridging screw to project from the front surface of the frame so that the flatness of the cloth is not adversely affected by the rear end of the bridging screw.

According to a fifth aspect of the present invention, each of the frame-pieces for forming the cloth fixing frame is provided with a hollow portion into which each of the corner members is press-fitted such that either the surface of the corner members or the inner wall surface of the hollow portion is provided with a crushable portion which is crushed when the corner member is press-fitted into the hollow portion. According to this cloth fixing frame, the frame-pieces can be assembled with ease since the frame-pieces can be coupled by press-fitting each corner member between the adjoining frame-pieces.

According to a sixth aspect of the present invention, each of the frame-pieces is provided at the inner side surface thereof with a crosspiece fitting groove so that both ends of a reinforcing crosspiece:can be fitted into such grooves of the opposing upper and lower frame-pieces of the cloth fixing frame. This type of frame has the advantage that even when the frame-pieces are large in length, they do not bend by the tensile force of the cloth due to the provision of the cross-piece.

According to a seventh aspect of the present invention, each of the frame-pieces is provided at the rear surface thereof with a picture-frame fitting groove whose opposing inner wall surfaces are corrugated so as to allow a screw to be screw-fitted thereinto. In this case, as the picture-frame fitting groove can be formed by extrusion-molding, a picture-frame can be attached in a simply manner by fitting a screw into the groove.

According to an eight aspect of the present invention, each of the frame-pieces having a U-shaped groove on the outer peripheral end surface thereof is harder than each of the fixing means and there are provided chipping receiving sections at the opposing inner wall surfaces of the U-shaped groove so that chippings from the surface of the fixing means generating as a result of driving the fixing means into the groove are accumulated in these sections. Therefore, it is possible to prevent the cloth from getting swollen due to the chippings.

DESCRIPTION OF PREFERRED EMBODIMENTS

Figure 1:
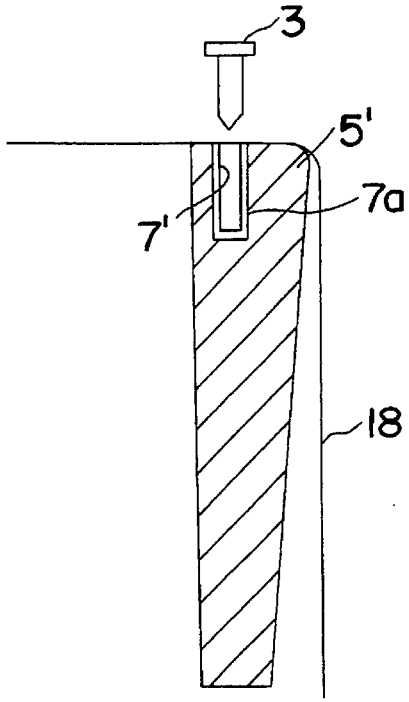
FIG. 1 is a sectional view of the essential portion of a cloth fixing frame according to a first embodiment of the present invention.

A cloth fixing frame according to a first embodiment of the present invention will now be described with reference to FIGS. 1 through 4. FIG. 1 is a sectional view of a cloth fixing frame 1 which is used as a canvas fixing frame. The cloth fixing frame 1 provided with a surface projection 5' near the outer periphery of the front surface thereof and a fixing means fitting groove 7' on the outer peripheral end surface thereof. The cloth fixing frame 1 is made of various kinds of boards made of wood or plywood, synthetic resin or metallic materials. The surface projection 5' is formed such that the front surface of the frame 1 is tapered downward so that thickness of the outer peripheral portion of the frame is smaller than that of the inner peripheral portion thereof. Further, the fixing means fitting groove 7' is formed on the outer peripheral end surface at a position near the rear surface of the frame.

Reference numeral 18 designates a cloth, i.e., a canvas spread over the frame 1 and reference numeral 3 designates a fixing means to be fitted into the groove 7' for positioning and fixing the canvas 18 to the frame 1. The fixing means 3 has a sharp top end so that it can be pierced through the canvas 18. Further, it has a width a little larger than the width of the groove 7' so as to be press-fitted into the groove 7' and the length thereof is made equal to, or larger than, the depth of the groove, so that it can be fully or partly inserted into the groove. Usually, a metallic nail or screw comprising a head and a shank. Especially, where the frame 1 is made of a metallic material, it is preferable that the fixing means 3 be made of a material softer than the frame 1.

Reference numeral **7*a* is a U-shaped metallic or plastic reinforcing member to be inserted into the fixing means fitting groove 7' so as to reinforce the latter. However, where the frame 1 is made of a metal such as aluminum, the reinforcing member 7*a* is not required. Thus, due to the provision of the reinforcing member 7*a*, it is possible to position the fixing means 3 into the groove 7' and to prevent the frame 1 from cracking due to the tensile force of the canvas 18. By the way, the reinforcing member 7*a* is not always required to be U-shaped in section but it may be of a shape suitable for it to be applied to a part of the three wall surfaces of the groove 7'**.

Figure 2:
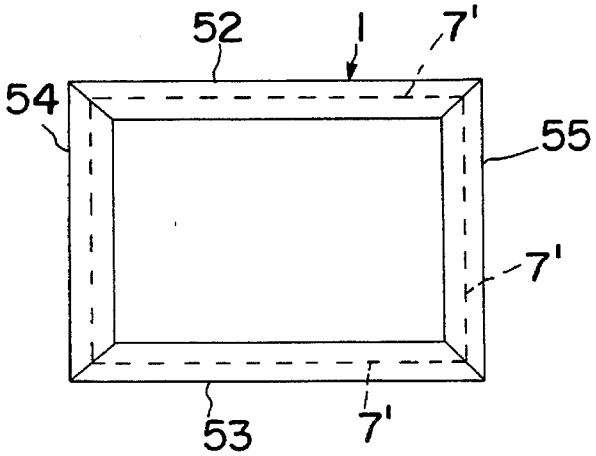
FIG. 2 is a front view of a cloth fixing frame of the present invention shown in FIG. 1.

FIG. 2 is a front view of the cloth fixing frame 1. The frame 1 comprises a pair of horizontal frame-pieces 52 and 53 and a pair of vertical frame pieces 54 and 55, and both ends of these frame-pieces are combined and coupled with each other by suitable means such as wedges.

Then, the canvas 18 is placed over the frame 1 thus assembled as shown in FIG. 1 and is fixed to the frame 1 by driving the fixing means into the groove 7' through the canvas while stretching the canvas 18.

Figure 3:
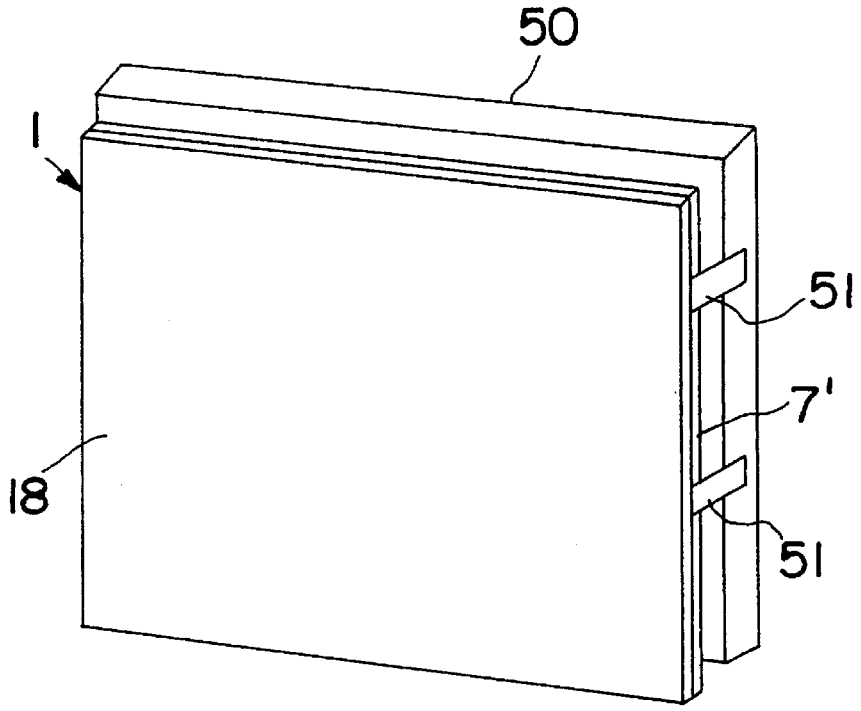
FIG. 3 is a perspective view of the cloth fixing frame shown in FIG. 2, especially in a state in which the cloth fixing frame fixed with a close is supported on a wooden frame.
Figure 4:
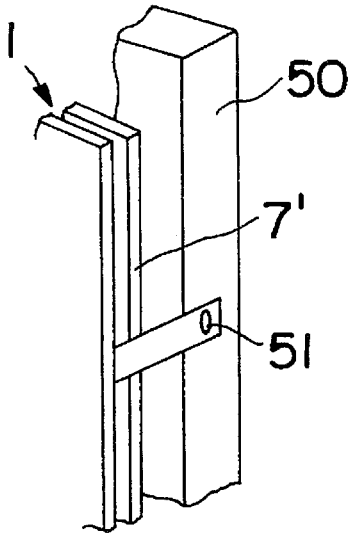
FIG. 4 is a partial enlarged view of the cloth fixing frame shown in FIG. 3.

FIGS. 3 and 4 show a state in which the cloth fixing frame 1 is fixed to a hard wooden frame 50 which is the same in size as the frame 1, through fittings 51 removably attached to the groove 7'. The reason for the use of such wooden frame is that the cloth fixing frame 1 fixed with the canvas 18 is unsteady due to its small thickness and it is inconvenient for actual painting. The frame 1 with the canvas 18 may be removed from the wooden frame 50 after painting.

According to this embodiment, due to the formation of the surface projection 5' on the outer periphery of the front surface of the frame 1 and the fixing means fitting groove 7' on the outer peripheral end surface of the frame, the canvas 18 can be fixed to the frame 1 in a simple manner such that the canvas 18 is first spread over the frame and the fixing means 3 are driven into the fixing means fitting groove 7' through the canvas 18. In this case, due to the provision of the groove 7' for positioning the fixing means 3, the fixing means can be fixed to the frame 1 with ease and since many of such fixing means 3 can be arranged in a straight line along the groove 7', it is possible to prevent the canvas 18 from swelling upward as has hitherto been observed so that the flatness of the canvas 18 can be secured and the cloth fixing frame 1 can be thinned.

Further, since the fixing means fitting groove 7' is formed on the outer peripheral end surface of the frame at a position near the rear surface of the frame 1, the frame 1 can be made thinner and the head of each fixing means 3 is prevented from projecting toward the front surface of the frame 1 thereby securing the flatness of the canvas.

By the way, the coupling of the horizontal pieces 52, 53 and the vertical pieces 54, 55 may be reinforced by using nails and the like or by applying a splint and slat to the corners the frame 1.

FIGS. 5 through 15 show a cloth sticking frame according to a second embodiment of the present invention. That is, the cloth fixing frame is formed of a plurality of frame-pieces **1*a* through 1*d* and is provided with corner members 2 and fixing means 3. The frame pieces 1*a* through 1*d* are produced by extrusion-molding an aluminum material and as shown in FIGS. 5 through 8, the frame pieces 1*a* and 1*c* become an upper and a lower frame element, respectively, and the frame pieces 1*b* and 1*d*** become vertical side frame elements, respectively, with both ends of each of the frame-pieces are tilted so as to extend along the diagonal line of a square or a rectangle formed by combining the frame-pieces.

Each of the frame-pieces **1*a* through 1*d* has a groove 7 the outer side surface thereof and a cloth fixing surface projection 5 ahead of the groove 7. Where each frame-piece is made of aluminum, the thickness t between the rear surface of each of the frame-pieces 1*a* through 1*d* and the groove 7 is made to be more than 5 mm. Further, the groove 7 is provided, on the opposing inner surfaces thereof, with symmetrical corrugations 8 coming into frictional engagement with the leg 19 of the fixing means 3**.

Further, each of the frame-pieces **1*a* through 1*d* has first and second coupling hollow portions 4*a* and 4*b* in the direction of width thereof of which the first hollow portion 4*a* is formed between the groove 7 and the front surface of the frame piece and the second hollow portion 4*b* is formed at a position biased toward the inner side surface of the frame-piece. Further, each of the frame-pieces 1*a* through 1*d* is provided with a plurality of through-holes 10 at the front or rear surface near both end portions thereof with the through-holes communicating with the coupling hollow portions 4**.

Further, each of the frame-pieces **1*a* through 1*d* has its front surface 13** gently tilted downward from its outer side end toward the inner side end.

Further, in the instant embodiment, each of the frame-pieces **1*a* through 1*d* has a crosspiece fitting groove 12 on the inner side surface thereof. This groove 12 has its front side wall 25 elongated and thee rear side wall 26 shortened. Further, each frame-piece is provided at the rear surface thereof with a picture-frame fitting groove 11 having its inner surfaces corrugated to receive a screw. In the instant embodiment, the convex portions of one of the corrugated inner surfaces of the groove 11 correspond to the concave portions of the other corrugated inner surface of the groove. The groove 11 opens at the rear surface of each of the frame-pieces at a position between the bottom of the groove 7 and the second hollow portion 4***b*. Reference numeral 9 designates a groove for perforation.

Figure 5:
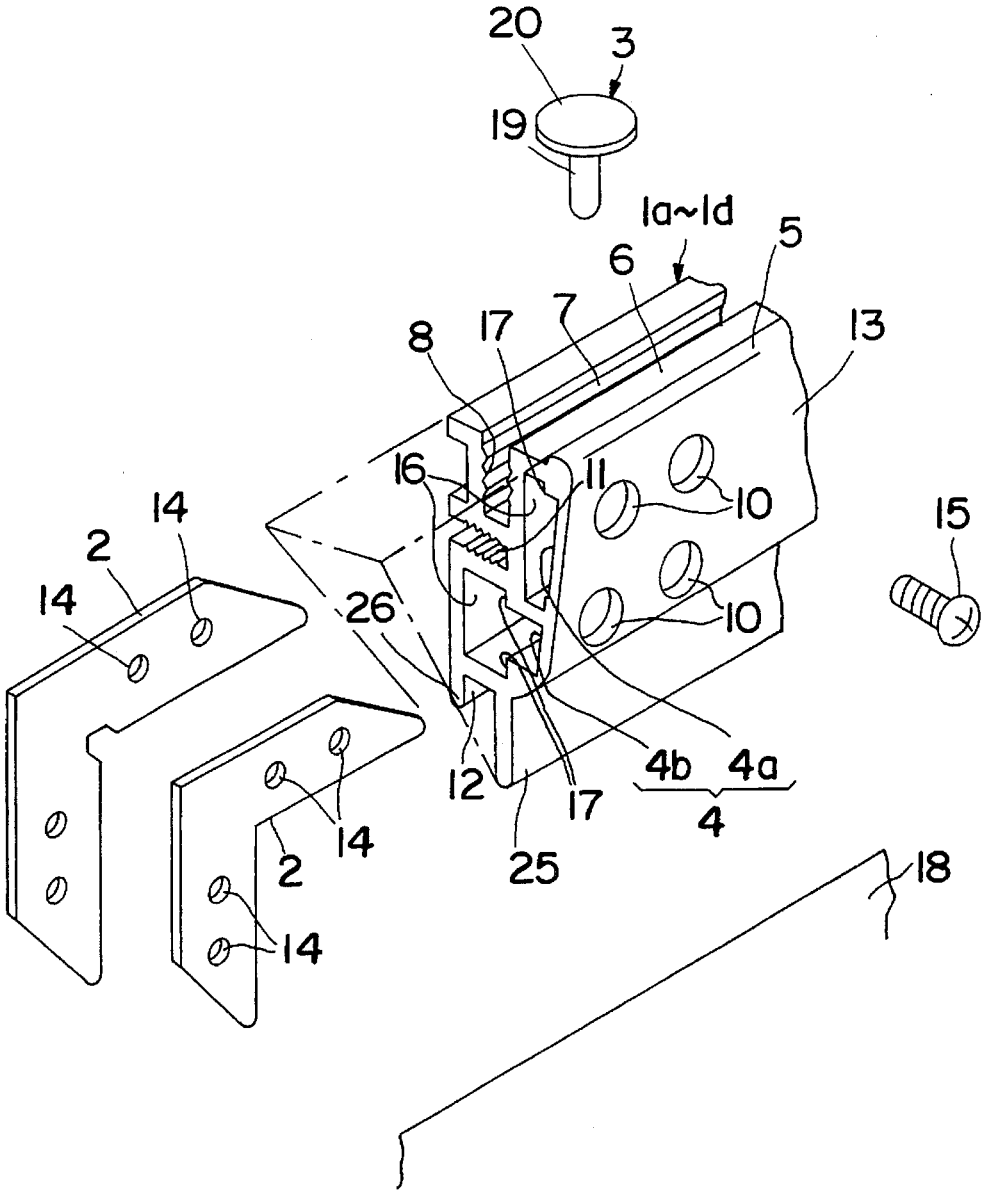
FIG. 5 is a perspective view (partly broken away) of cloth fixing frame according to a second embodiment of the present invention.
Figure 6:
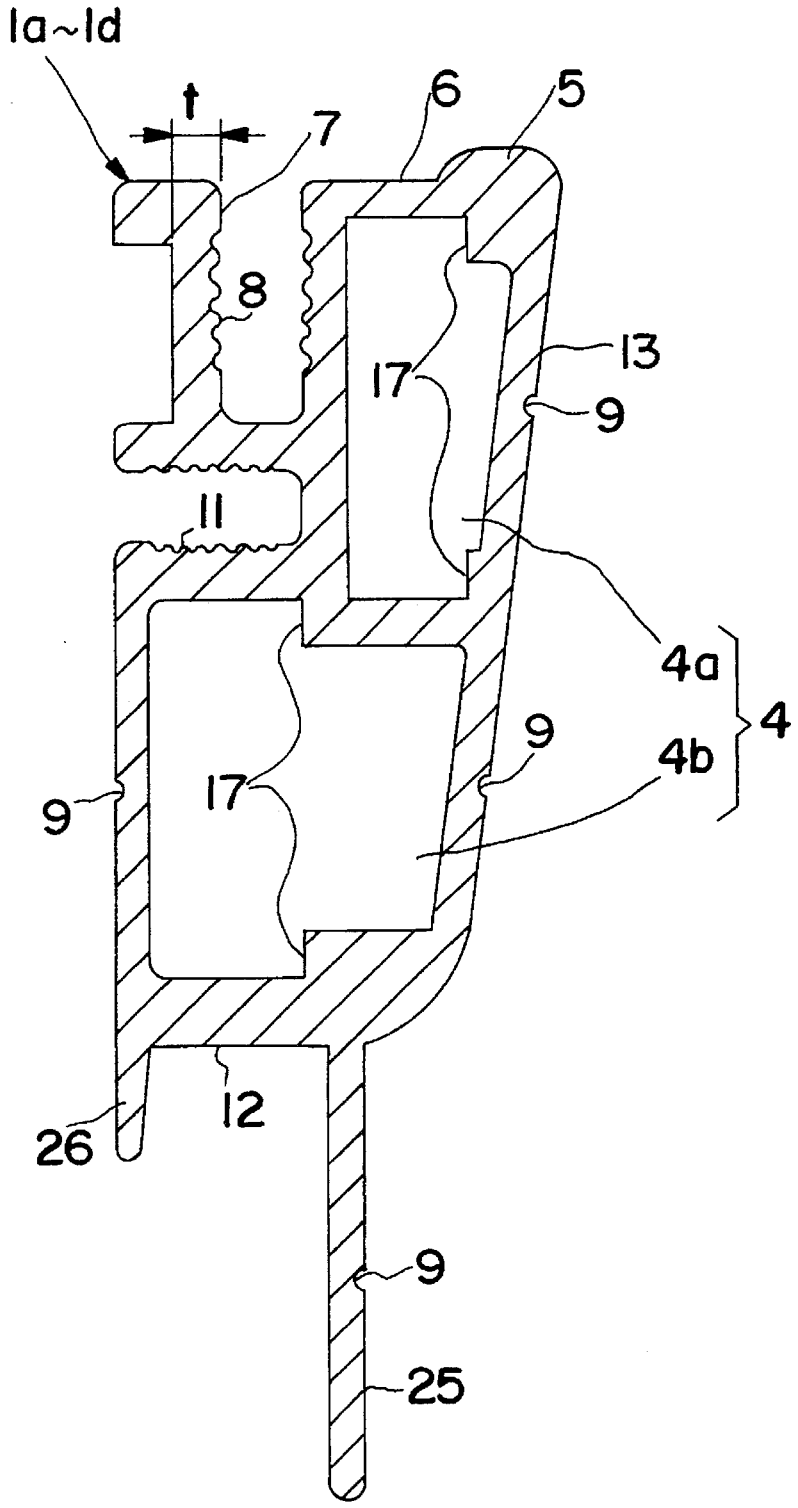
FIG. 6 is a sectional view of a frame-piece forming part of the cloth fixing frame shown in FIG. 5.
Figure 7:
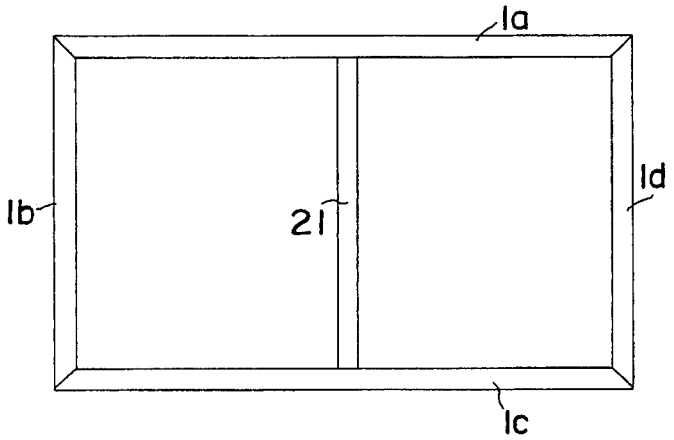
FIG. 7 is a front view of the cloth fixing frame shown in FIG. 6.
Figure 8A:
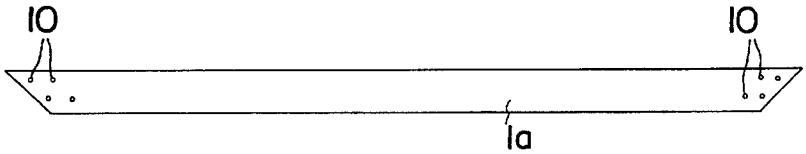
FIGS. 8(*a*) through (*e*) are front views of frame-pieces, respectively, of which (*a*) shows an upper frame-piece, (*b*) shows a lower frame-piece, (*c*) and (*d*) show side frame-pieces, respectively, and (*e*) shows a reinforcing crosspiece.
Figure 8B:
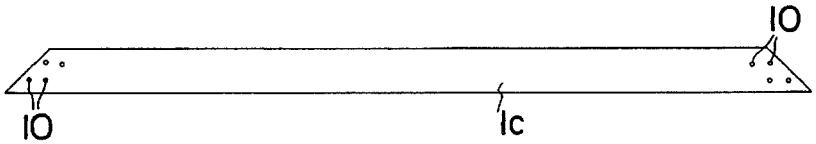
Figure 8C:
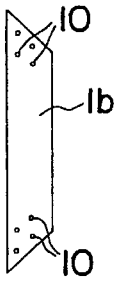
Figure 8D:
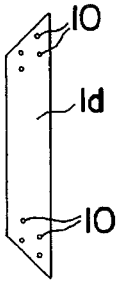
Figure 8E:
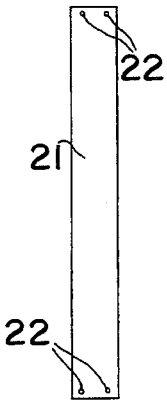
Figure 9:
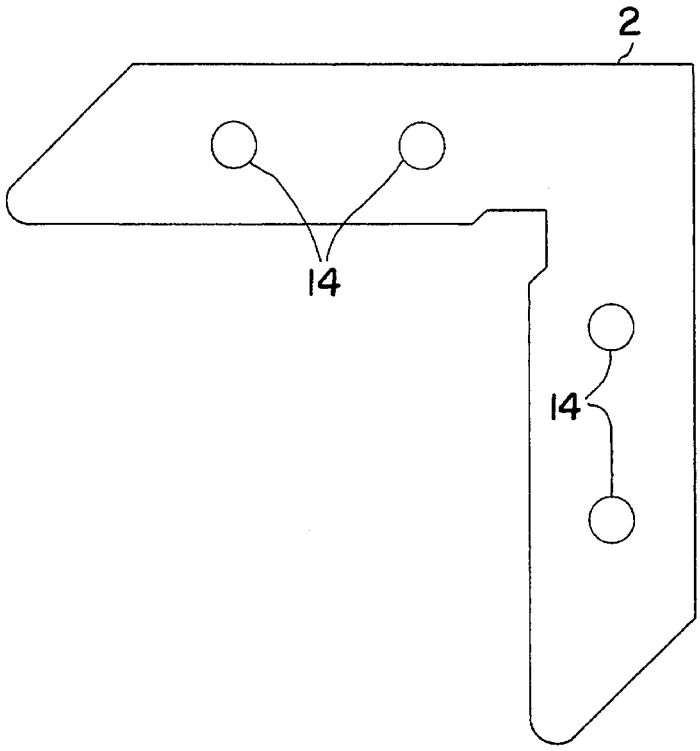
FIG. 9 is a front view of a corner member forming part of the cloth fixing frame shown in FIG. 5.

As mainly shown in FIGS. 5 and 9, each of the corner means 2 which are adapted to couple the frame-pieces 1*a* through 1*d* is provided with a plurality of screw-threaded holes 14 so as to correspond to the coupling hollow portions and to be in alignment with the through-holes 10. For coupling the frame-pieces 1*a* through 1*d*, both ends of the corner means 2 are loosely fitted between the adjoining frame pieces 1*a* and 1*b*, a bridging screw 15 is loosely fitted into each of the through-holes 10 so as to be screw-fitted into the screw-threaded hole 14 with the top end of the bridging screw 15 abutting against the inner surface 16 of each of the hollow portions 14 so that the corner member 2 is pressure-fixed to the front end 17 of the hollow portion 4. Consequently, the head of the bridging screw 15 is held within the through-hole 10 without sharply projecting from the front surface 13 of each of the frame-pieces 1*a* through 1*d*. Further, it is possible to use a headless screw. Thus, by coupling the frame-pieces 1*a* through 1*d* by the corner means 2, the frame shown in FIG. 7 can be formed.

Figure 15A:
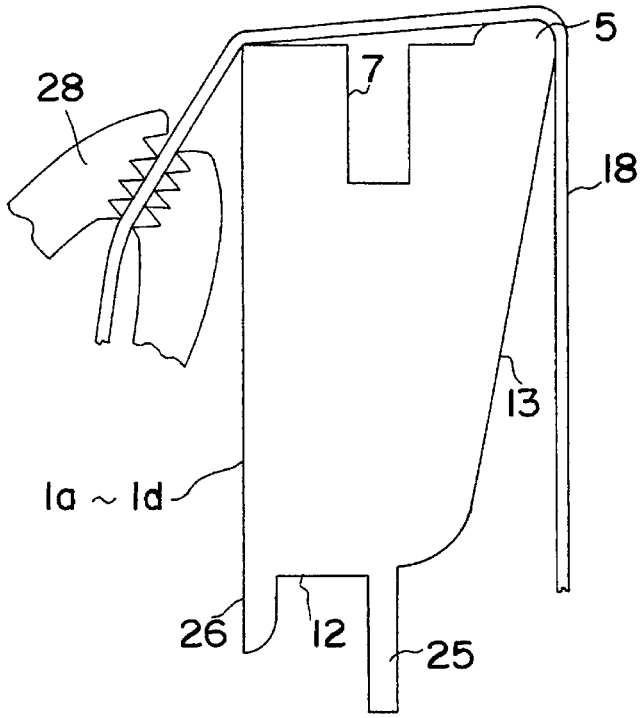
FIGS. 15(*a*) and 15(*b*) are diagrams illustrating how a cloth is fixed to a cloth fixing frame of the present invention.
Figure 15B:
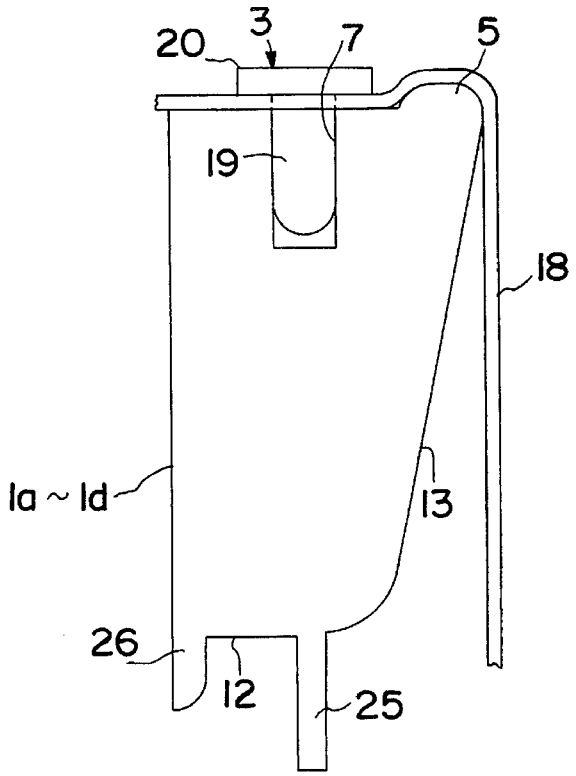

The fixing means 3, as mainly shown in FIG. 5, is adapted to fix a cloth 18 to be stretched over the front surface of the frame formed by the frame-pieces 1*a* through 1*d*. In the instant embodiment, this means 3 has a leg 19 capable of fitting in the groove 7 through the cloth 18 and a head 20 for pressing the cloth 18 against the outer end surface 6 so as to stretch the cloth. The diameter of the fixing means 3 is made somewhat larger than the width of the groove 7, for example, the width of the groove 7 when the diameter is less than 3 mm, e.g., 2.8±0.15. As shown in FIG. 15(*a*), the cloth 18 is placed on the front face 13. Then the outer periphery of the cloth 18 is turned over the outer end surface 6 of the assembled frame so as to be stretched toward the rear surface of the frame with pinchers 28 and the leg 19 of the fixing means 3 is thrusted into the groove 7 through the cloth 18 as shown in FIG. 5(*b*). As the cloth 18 is pressed against the outer end surface 6 of each of the frame-pieces 1*a* through 1*d* by the head 20 of the fixing means 3, the central portion of the cloth 18 is stretched toward the outer periphery of the cloth. Further, since the inner wall surfaces of the groove 7 are corrugated as at 8, the leg 19 of the fixing means 3 is easy to frictionally engage the groove 7 but where the fixing means 3 is made of a material such as iron which is harder than the frame 1, it is sometimes held in engagement with the groove 7 by crushing the concave portions of the corrugated surfaces of the groove 7. On the contrary, where the fixing means 3 is made of aluminum while the frame is made of an aluminum alloy harder than aluminum, the surface of the fixing means 3 is sometimes abrased by the corrugated surfaces of the groove 7.

Figure 10A:
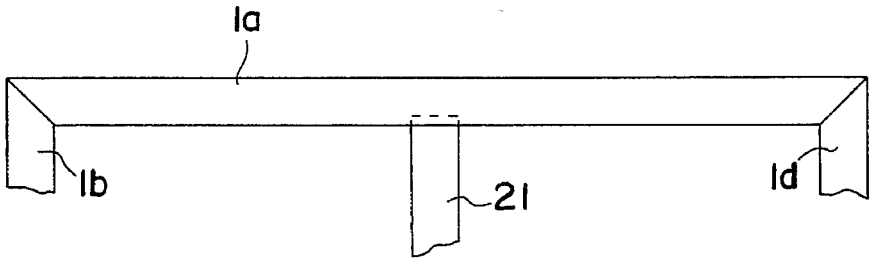
FIG. 10 are partial views of the frame of the present invention of which FIG. 10(*a*) shows the frame when it has a single, reinforcing crosspiece and FIG. 10(*b*) shows the frame when it has two reinforcing crosspieces.
Figure 10B:
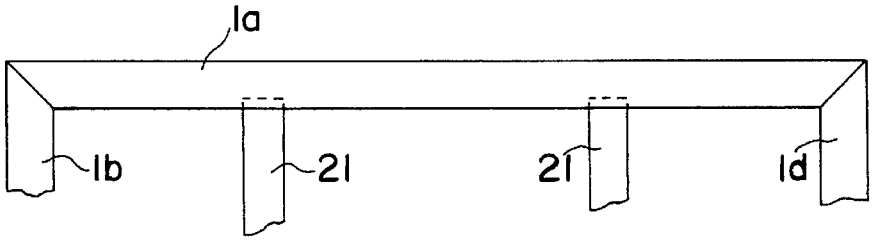
Figure 11:
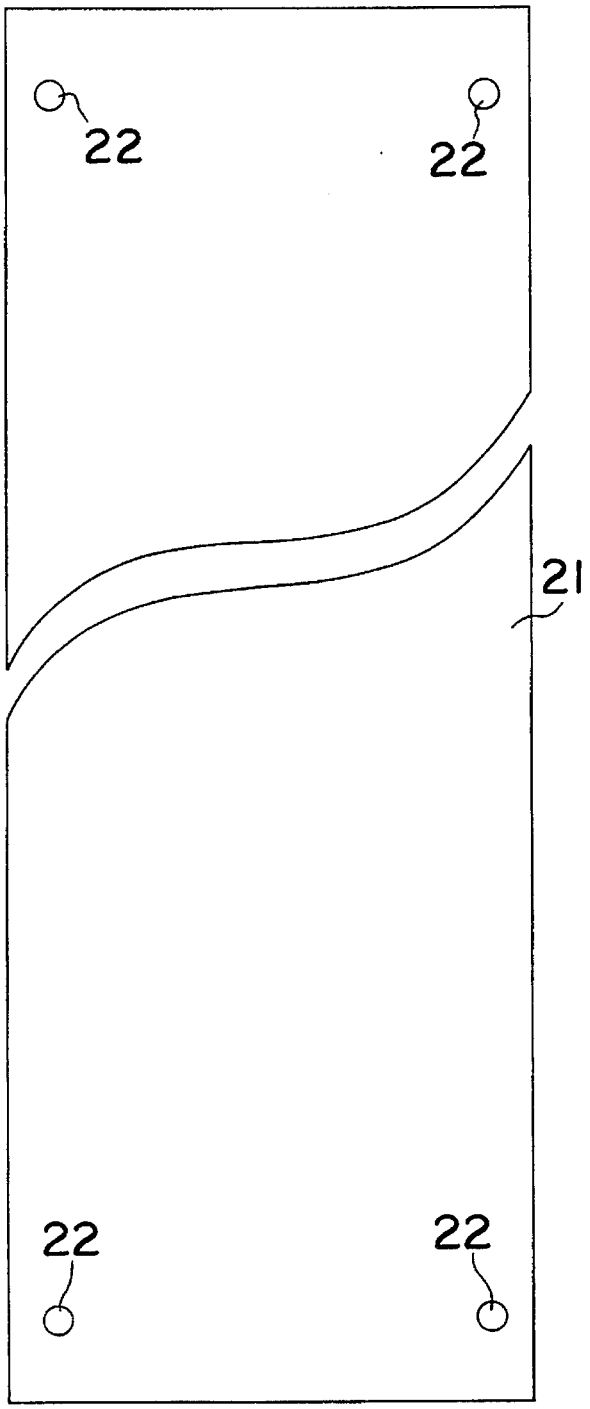
FIG. 11 is a front view (partly cut away) of a reinforcing crosspiece.
Figure 12:
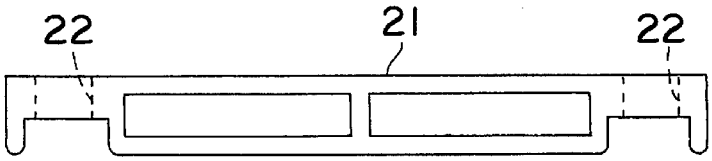
FIG. 12 is a sectional view of the reinforcing cross-piece shown in FIG. 11.

As shown in FIGS. 7, 10 through 12, a reinforcing crosspiece has both ends thereof engaged with the cross-piece engaging grooves 12 of the opposing framepieces 1*a* and 1*c*, respectively. The reinforcing crosspiece 21 in the instant embodiment is an extrusion-molded aluminum band-like plate having a thickness suitable for it to be fitted into the groove 12. The reinforcing crosspiece 21 which is larger than the height of the rear side strip 26 and smaller than the front side strip 25 is provided with screw-threaded holes 22 at both end portions thereof. Thus, the end of the reinforcing crosspiece 21 is inserted into the groove 12, a screw (not shown) is screwed into the screw-threaded hole 22 until the top end of the screw comes into engagement with the front side strip 25, fixing the reinforcing crosspiece 21 to the rear side strip 26. Unlike FIG. 10(*a*) where the reinforcing crosspiece 21 is arranged at the center of the cloth fixing frame 1, it is also possible to provide two such crosspieces as shown in FIG. 10(*b*).

Figure 13:
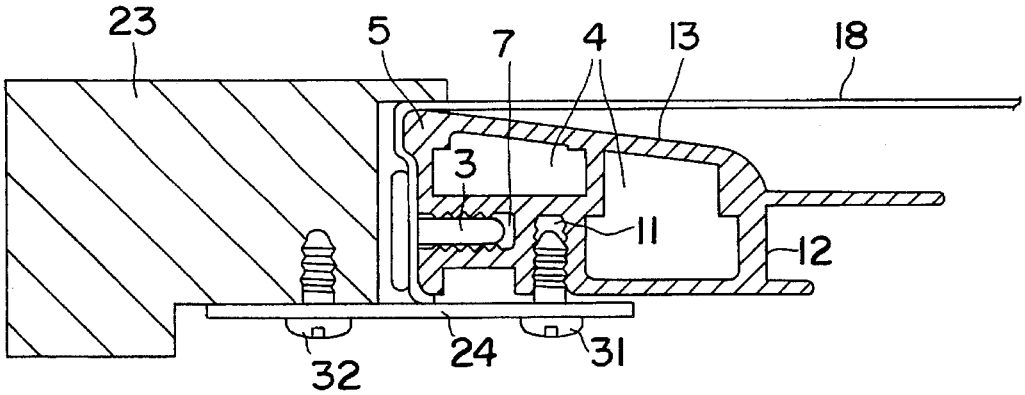
FIG. 13 is a partial sectional view of a picture frame to which a cloth fixing frame of the present invention is fixed.
Figure 14:
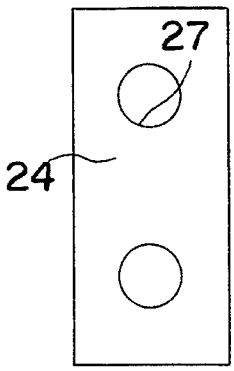
FIG. 14 is a front view of a coupling metal for the picture frame shown in FIG. 13.

As shown in FIG. 13, a picture frame 23 is so formed as to surround the outer periphery of the cloth fixing frame 1 and is fixed to the frame 1 such that a screw 32 is screw-threaded into the picture frame 23 through one of holes 27 drilled in a platelike coupling metal 24 and a screw 31 is screwed into the groove 11 through the other hole 27 of the coupling metal thereby fixing the picture frame to the cloth fixing frame 1.

According to the instant embodiment, the cloth fixing frame 1 is formed by coupling the frame pieces 1*a* through 1*d* with the fixing means 3 to be fitted into the coupling hollow portions 4 at the ends of each frame-piece, the cloth 18 is placed on the front surface 13 of the cloth fixing frame 1, the outer periphery of the cloth 18 is stretched toward the rear side of the frame 1 by using the pinchers 28 as shown in FIG. 15(*a*) and the fixing means 3 is fitted into the corresponding groove 7. Further, since the frame-pieces 1*a* through 1*d* are made of a metal or synthetic resin and extrusion-molded, the frame 1 can be manufactured with ease and can be made thinner than otherwise, and further since the fixing means 3 are fitted into the groove 7, they can be positioned in a straight line to thereby better the external appearance of the frame 1. Moreover, since the fixing means 3 do not project on the front side of the frame 1, the flatness of the stretched cloth 18 is not adversely effected.

In addition, since the inner wall surfaces of the groove 7 are corrugated as at 8 so as to come into frictional contact with the leg 19 of the fixing means the fixing means 3 can be easily fitted and removed and can be securely fixed.

Moreover, each of the frame pieces 1*a* through 1*d* has the coupling hollow portion 4 with the through-holes 10 at both ends of the hollow portion 4, a plurality of corner means 2 having the screw-threaded holes 14 to align with the through-holes 10 are provided to correspond to the coupling hollow portions 4 and the bridging screw 15 to be screwed into the screw-threaded hole 14 through the through-hole 10 so as to press each of the corner means against the front end of the coupling hollow portion 4. Therefore, the corner members 2 can be securely fixed to the frame pieces with the bridging screws 15 to thereby secure the strength of the frame 1 and since the frame-pieces 1*a* through 1*d* can be coupled from on the front side by using the bridging screws 15, they can be assembled with ease. Further, since the top end of the bridging screw 15 screwed into the hole 14 is caused to abut against the inner wall of the hollow portion 4, the corner means 2 is tightened against the front end of the coupling hollow portion 4. Therefore, the rear end of the bridging screw 15 does not project on the front side of the frame 1 which results in keeping the flatness of the cloth unchanged.

Each of the frame pieces 1*a* through 1*d* has the bridge fitting groove 12 on the inner side surface thereof and the reinforcing crosspiece 21 has both ends thereof fitted into such grooves of the opposing frame pieces so that even when the frame pieces are elongated, they are prevented from becoming deflected due to the stretching of the cloth 18.

Further, each of the frame pieces 1*a* through 1*d* is provided at the rear surface thereof with the picture frame fitting groove 11 whose inner surfaces are corrugated to receive a screw, so that the picture frame 23 can be easily attached to the cloth fixing frame by fitting the screw into the groove 11.

Figure 16:
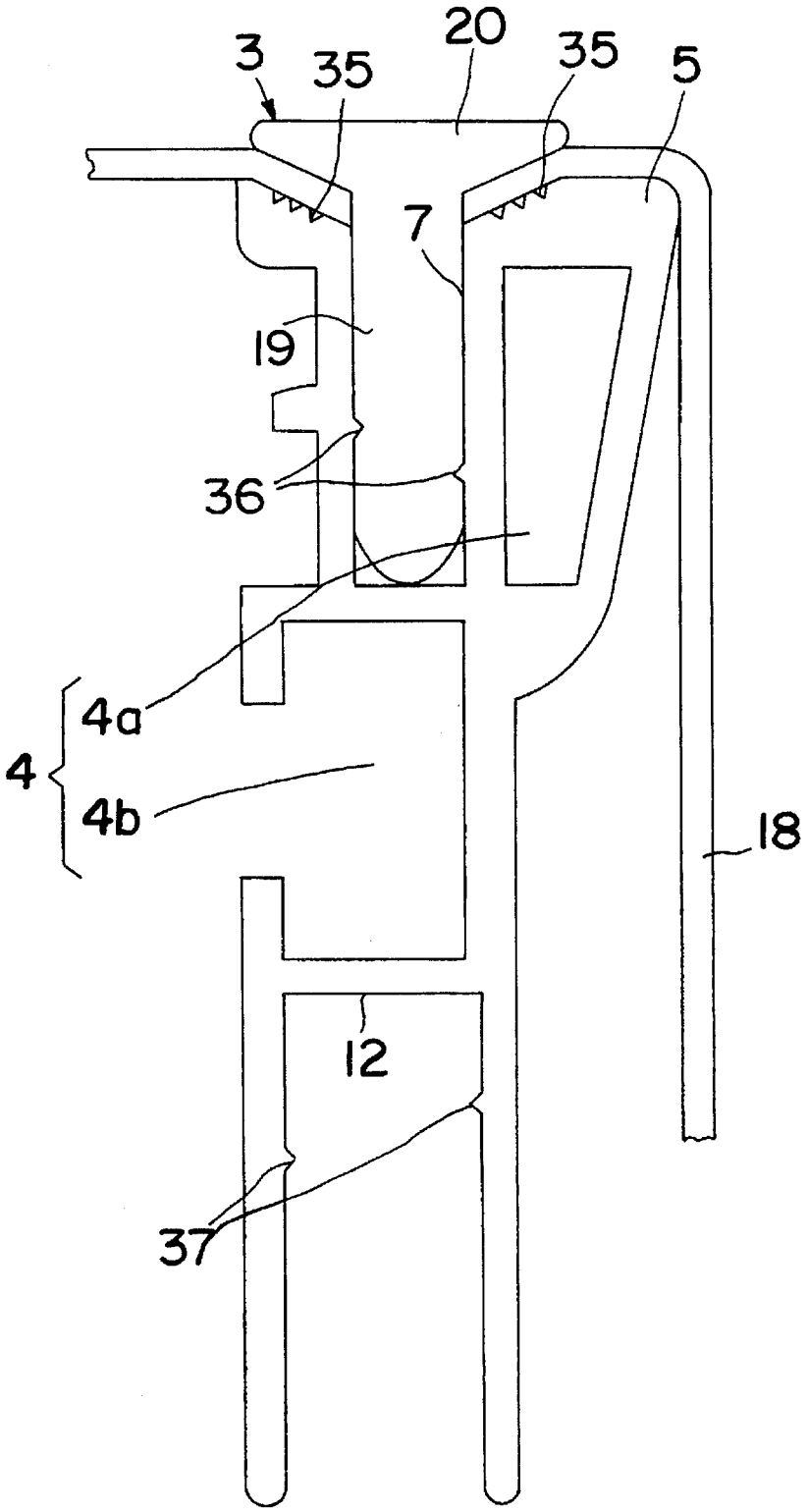
FIG. 16 is a partial sectional view of a cloth fixing frame according to a third embodiment of the present invention.
Figure 17:
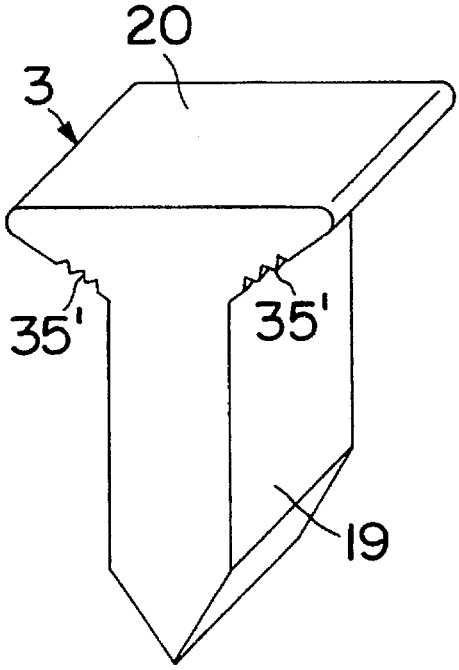
FIG. 17 is a perspective view of a fixing means used with the cloth fixing frame shown in FIG. 16.

FIGS. 16 and 17 show a cloth fixing frame according to a third embodiment of the present invention. The cloth fixing frame according to this embodiment is devoid of the picture frame fitting groove 11 which is formed in that according to the second embodiment of the present invention. The cloth fixing projection 5 is formed on the side of the front end of the groove 7 by providing a V-shaped dent at the edge of the opening of the groove 7. Further, corrugations 35 for preventing the slippage of the cloth 18 are formed on the inclined surfaces extending downward from the opening endgs of the groove 7. The groove 7 is also provided on each of the inner surfaces thereof with a single ridge 36 and the bridge fitting groove 12 is also provided on each of the inner wall surfaces thereof with a single ridge 37. Thus, by fitting the leg 19 of the fixing means 3 or the reinforcing bridge 21 into the groove 11 or 12, the cloth 18 can be fixed at the possible crushing of the ribs 36 or 37. Further, where the fixing means 3 is made of a material softer than the cloth fixing frame 1, the surface of the leg 19 of the fixing means 3 is abrased by the rib 36 or becomes dented.

Further, as shown in FIG. 17, the leg of the fixing means 3 is made platelike with its top end being V-shaped in section so as to be suitable for fixing the cloth 18 and the head 20 thereof has a V-shaped lower surface. This platelike leg prevents the distortion of the frame pieces 1*a* through 1*d*. Further, there is sometimes a case where anti-slippage corrugations 35' are also formed on the lower surface portions, respectively, of the head 20 of the fixing means.

Figure 18:
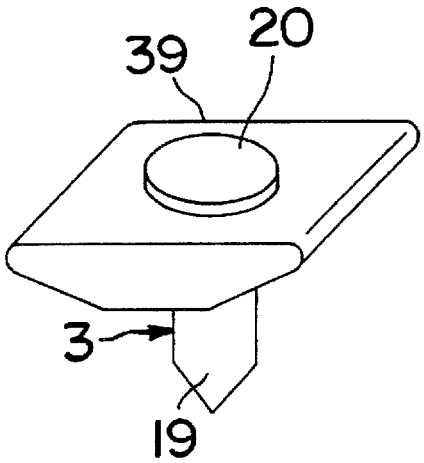
FIG. 18 is a perspective view of a modification of the fixing means shown in FIG. 17.

FIG. 18 shows a modification of the fixing means 3 of FIG. 17 (the third embodiment) which modification comprises a leg similar to the leg 19 of the fixing means 3 of the second embodiment and a seat plate 39 same in shape as the head 20 of the fixing means 3 of the third embodiment and having a through-hole for the leg.

Figure 19:
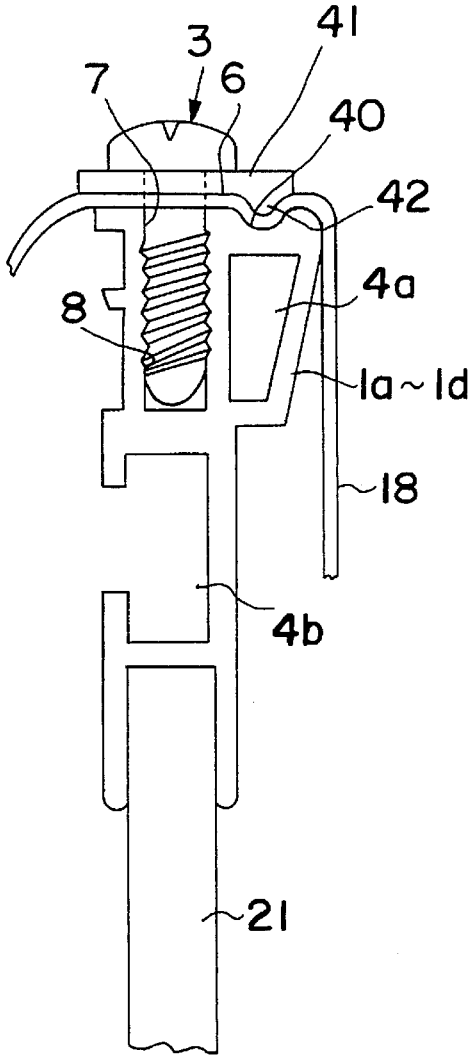
FIG. 19 is a partial sectional view of a cloth fixing frame according to a fourth embodiment of the present invention.

FIG. 19 shows a cloth fixing frame according to a fourth embodiment of the present invention. This cloth fixing frame is an example which is devoid of the picture frame fitting groove 11 of the frame of the second embodiment of the invention in FIG. 5. According to this embodiment, a groove 40 is formed on the outer side surface 6 of each of the frame-pieces so that the cloth stretching rib 5 is formed on the front end of the outer side surface 6. Further, the fixing means 3 is attached with a seat plate 41 which has a rib 42 to engage the groove 40. Further, the corrugations 8 on the inner wall surfaces of the groove 7 are formed such that the convex and concave portions of one of the corrugations correspond to the concave and convex portions of the other corrugation, respectively, so that the fixing means 3 can be screwed into the groove 7 with the corrugations 8 acting as a female screw.

With the above structure, when the cloth 18 is placed over the outer side surfaces 6 of the frame-pieces 1*a* through 1*d* and the fixing means 3 is screwed into the corresponding groove 7 of each of the frame-pieces 1*a* through 1*d*, the cloth 18 is pressed into the groove 40 due to the rib 42 formed on the seat plate 41 to thereby stretch the cloth 18. The seat plate 41 may be made of a metal, resin, rubber, cork or the like material.

The material for the frame-pieces 1*a* through 1*d* and the reinforcing strip 21 is not always limited to aluminum but it may be any other metal or synthetic resin only if it can be suitable for extrusion-molding. The corner means 2 may also be made of a metal or synthetic resin material. Further, the cloth fixing frame according to the third embodiment of the present invention shown in FIG. 16 is formed of the frame-pieces 1*a* through 1*d* each is provided with the anti-slippage corrugations at the opening edge of the groove 7 on the outer side surface 6 thereof but a part or whole of the outer side surface 6 including the cloth stretching rib 5 may be provided with an anti-slippage corrugation. Further, the front side piece 25 of the crosspiece engaging groove 12 of each frame piece of the second embodiment may be provided with a hole through which a screw is screw-fitted into the screw-threaded hole of the reinforcing crosspiece 21 and the reinforcing cross-piece 21 may be fastened to the front side piece 25. Further, the fixing of the corner members 2 to fit in the second hollow portion 4*b* of each frame-piece may be made by means of a screw through a hole drilled in the rear surface thereof. In addition, the frame-pieces 1*a* through 1*d* may be coupled together with the corner members in the rear sides of the frame-pieces.

Figure 20:
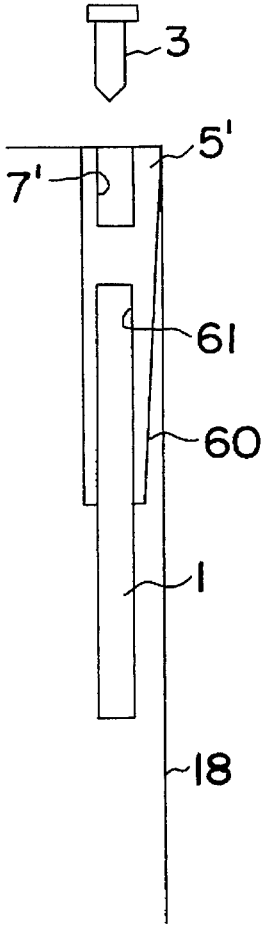
FIG. 20 is a sectional of the essential portion of a cloth fixing frame according to a fifth embodiment of the present invention.
Figure 21:
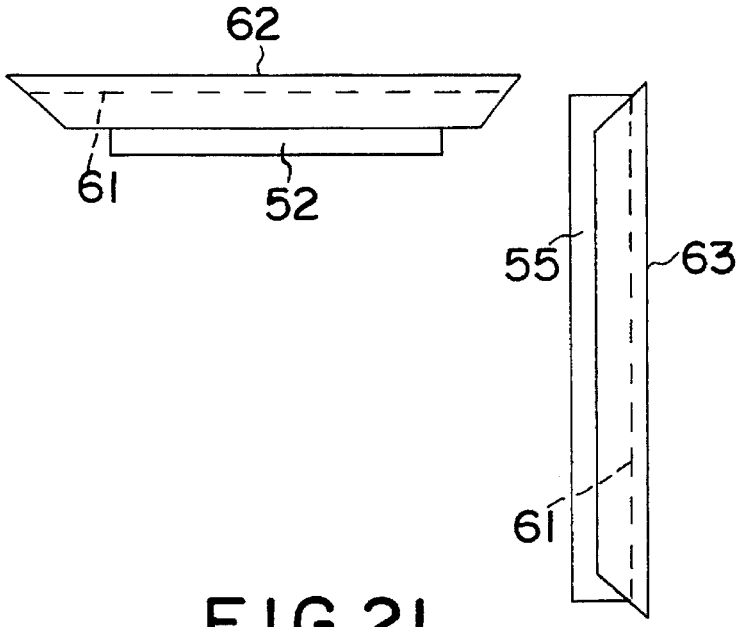
FIG. 21 is a partial front view of the cloth fixing frame especially in a state in which it is fitted in a reinforcing frame.
Figure 22:
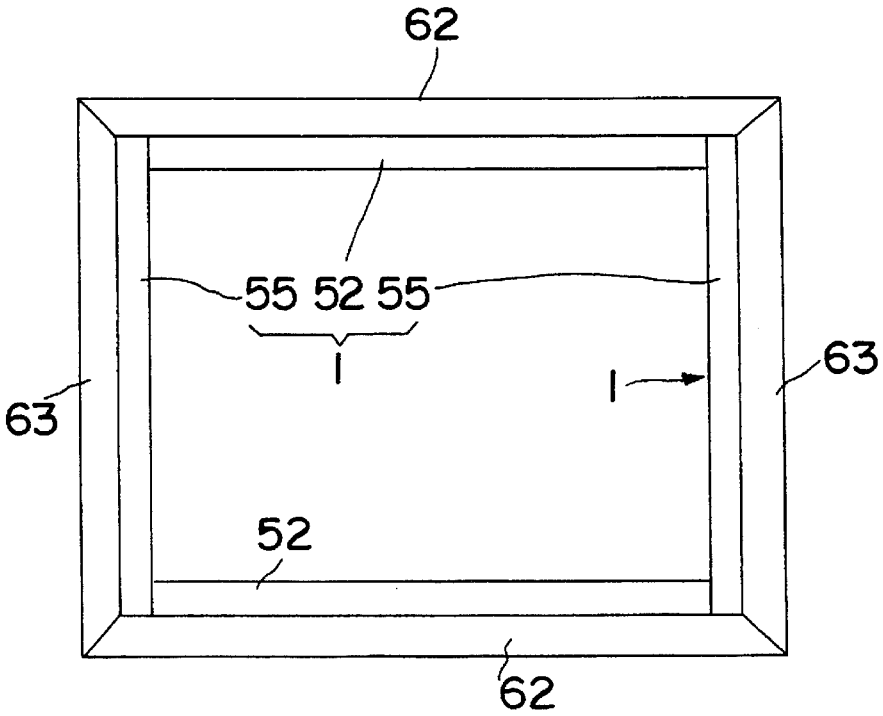
FIG. 22 is a front view of the cloth fixing frame shown in FIG. 20 in its entireties.

FIGS. 20 through 22 show a cloth fixing frame according to a fifth embodiment of the present invention. This frame has its outer periphery covered with a reinforcing frame 60 which is provided with a surface projection 5' and a fixing means fitting groove 7'. As shown in FIGS. 21 and 22, the reinforcing frame 60 comprises a pair of horizontal strips 62 and a pair of vertical strips 63 with both ends of each of these strips being made aslant so as to be coupled together with ease. Further, it has an internal groove 61 for allowing the cloth fixing frame 1 to be fitted therein. The cloth fixing frame 1 comprises a pair of horizontal pieces 52 and a pair of vertical pieces 55 with both ends of each of these strips being cut not alsnat but vertical so that they are coupled together in such a manner that the end faces of the horizontal pieces 52 are coupled to the side end portions of the vertical pieces, respectively, and both ends of each of the vertical pieces 55 fit into the grooves of the horizontal pieces 52.

The reinforcing frame 60 is made of a metal such as aluminum but it, may be made of plastic or ceramic material. Further, the cloth fixing frame 1 may be made of a wooden, metallic or resin material.

According to this embodiment, it is possible not only to increase the strength of the cloth fixing frame 1 but also to control the deflection of the frame due to the reduction of thickness of the frame.

Figure 23:
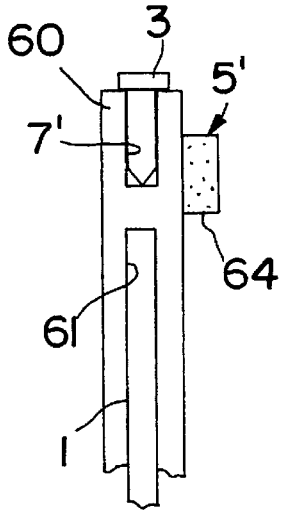
FIG. 23 is a sectional view of the essential portion of a cloth fixing frame according a sixth embodiment of the present invention.
Figure 25:
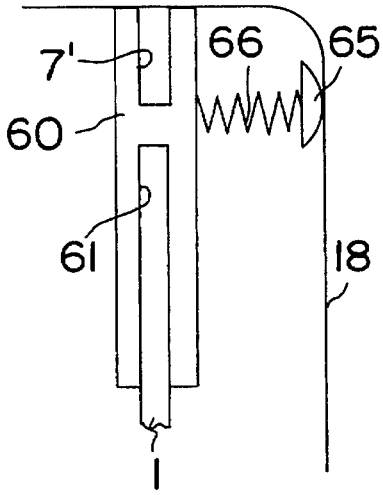
FIG. 25 is a sectional view of the essential portion of another modification of the cloth fixing frame shown in FIG. 23.
Figure 24:
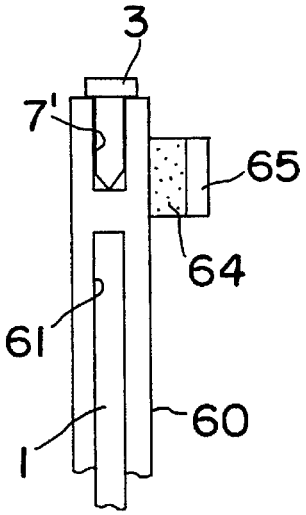
FIG. 24 is a sectional view of the essential portion of a modification of the cloth fixing frame shown in FIG. 23.
Figure 26:
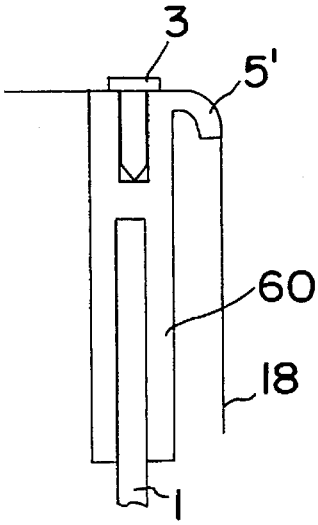
FIG. 26 is a sectional view of the essential portion of still another modification of the cloth fixing frame shown in FIG. 23.

FIGS. 23 through 26 show a cloth fixing frame according to a sixth embodiment of the present invention. Unlike the cloth fixing frame of the first embodiment, this cloth fixing frame has its front surface not tapered but held parallel to its rear surface and is provided with an elastic surface projection 5'. There are various means for providing the elastic surface projection 5'. For example, FIG. 23 shows a surface projection in the form of an elastic member 64 made of sponge or rubber, FIG. 24 shows that in the form of the like elastic member whose surface is attached with a slidable plate 65, FIG. 25 shows that in the form of a coil spring having its one end attached with a slidable member 65 with the other end fixed to the frame 1 and FIG. 26 shows that in the form of an elastic metal strip 5' extending downward from the outer periphery of the frame along the front face of the frame. This metal strip has a thickness suitable for it to be elastically curved downward. In this case, it is necessary that the frame be also made of an elastic metal.

According to these embodiments, the cloth 18 can be easily spread with an increased tensile force suitable for painting. Further, the sectional area of the cloth fixing frame 1 can be made small and the weight of the frame can be made small as compared to the cloth fixing frame having a tapered surface projection along the inner periphery thereof. That is, the case of the frame having the tapered projection, when the width of the frame 1 becomes large, the angle of inclination of the tapered projection increases to increase the thickness of the frame but in the case of the frame having the surface projection 5' in the form of the elastic member 64, the thickness of the frame can remain unchanged even when the width of the frame becomes large.

Figure 27:
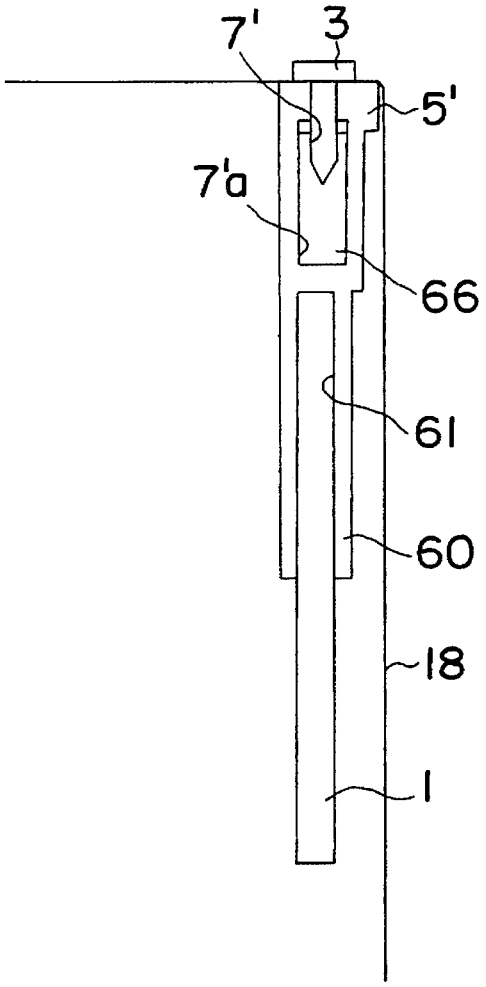
FIG. 27 is a sectional view of the essential portion of a cloth fixing frame according to a seventh embodiment of the present invention.

FIG. 27 shows a cloth fixing frame according to a seventh embodiment of the present invention. This embodiment is a modification of the fifth embodiment of the present invention shown in FIG. 20. That is, the width 7'*a* of the fixing means fitting fgroove 7' for fixing the four frame pieces, i.e., horizontal and vertical pieces 62 and 63 for forming the reinforcing frame 60 is made larger than the width of the open edge of the frame 60 in the case of the fifth embodiment and a fixing means driven member 66 made of a wooden material is inserted into the frame 60 from one end of the latter. Further, the outer surface of the frame 60 is provided with a plurality of steps instead of tapering the surface and the upper end thereof serves as the surface projection 5'.

According to this embodiment, the fixing means driving member 66 is securely fixed within the fixing means receiving groove 7' and the fixing means 3 can be easily driven into the fixing means driven member 66.

The structure of inserting the fixing means driven member 66 into the groove 7' can be applied to the other embodiments of the present invention.

Figure 28:
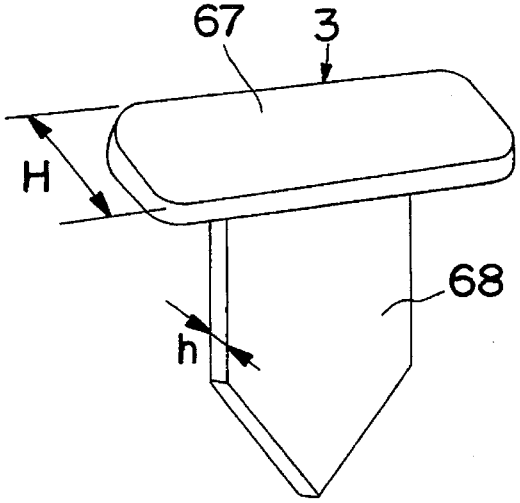
FIG. 28 is a perspective view of a fixing means to be used for the cloth fixing frames according to the first and second embodiments of the present invention.

FIG. 28 shows a fixing means for use with the cloth fixing frames according to the first and second embodiments of the present invention. That is, the fixing means 3 comprises a rectangular platelike head 67 whose shorter side has a width H small enough for the head not to jut out from the outer peripheral end or rear surface of the cloth fixing frame 1 and a shank 68 rectangular in section with a pointed lower end having a thickness h which is suitable for it to be press-fitted into the fixing means fitting groove 7', that is, which is substantially equal to the width of the groove 7'.

This embodiment has the advantages that the cloth or canvas 18 is hardly broken, the fixing means 3 can be easily positioned and since the head 67 is large, the fixing means 3 can be easily fitted into the groove 7'.

Further, since the fixing means 3 according to this embodiment can be driven into the cloth fixing frame, it can be applied to the cloth fixing frame having no fixing means receiving groove 7'. Further, the shape of the head 67 of the fixing means 67 mabe elliptical. For keeping the cloth fixing frame 1 steady when the frame is mounted on an easel, a needle may be driven at the center of the head 67.

Figure 29A:
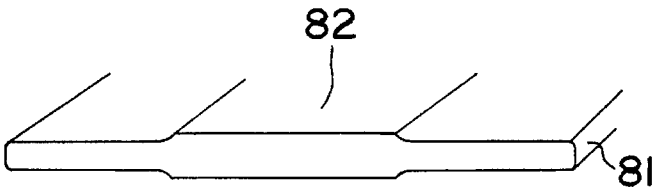
FIGS. 29(*a*) and 29(*b*) are partial perspective views of a band-shaped plate for forming a corner member used in an eighth embodiment of the present invention.
Figure 29B:
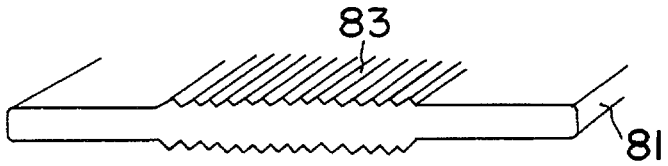
Figure 30:
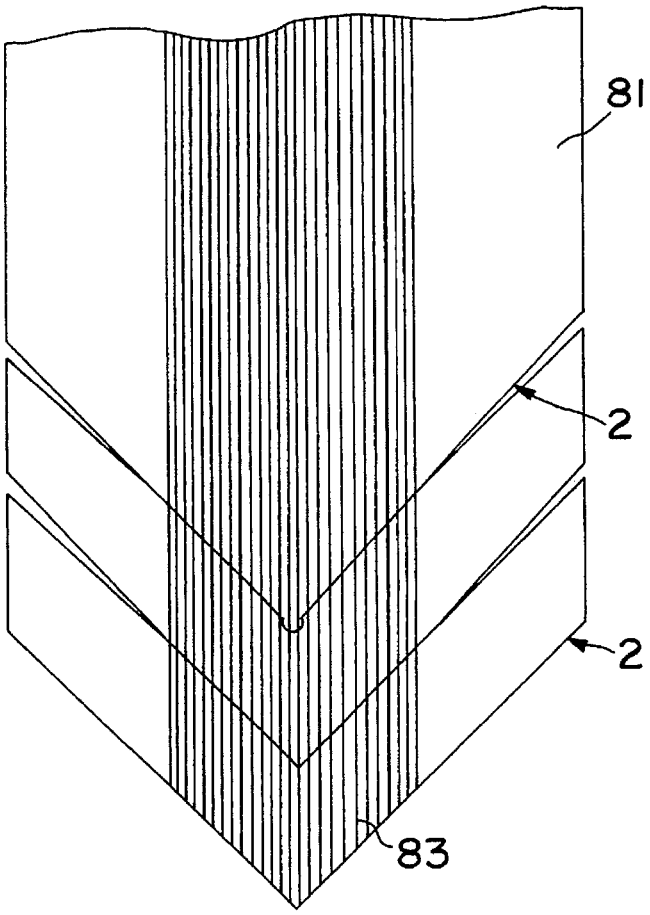
FIG. 30 is a partial plan view illustrating how the corner member used in the eighth embodiment of the present invention is cut.
Figure 31:
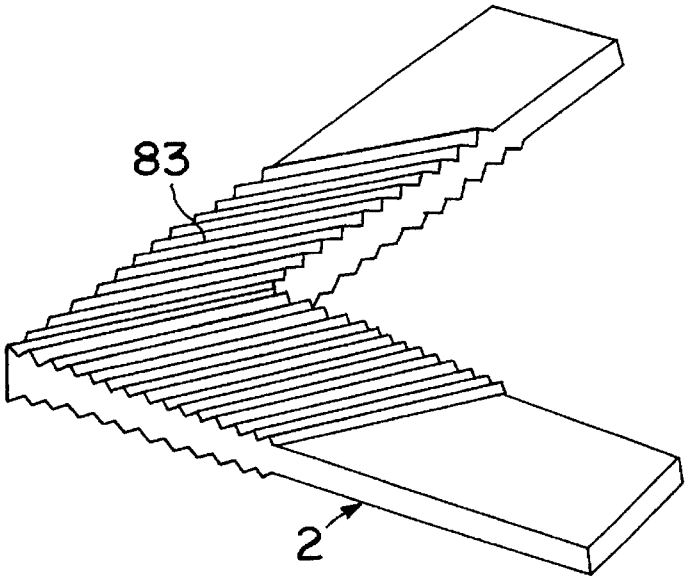
FIG. 31 is a perspective view of a corner member.
Figure 32:
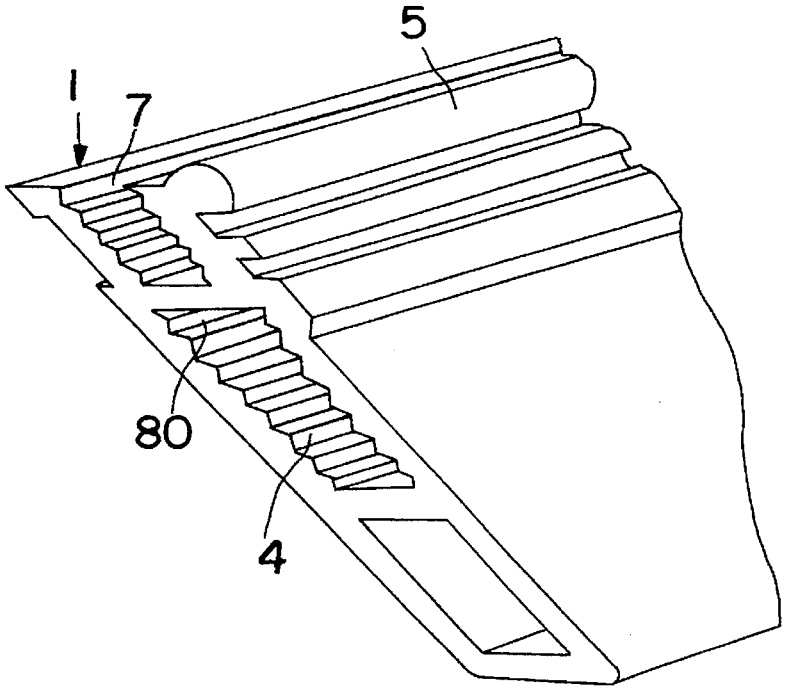
FIG. 32 is a perspective view (partially cut away) of a frame-piece used in the present invention.

FIGS. 29 through 33 show a cloth fixing frame according to an eighth embodiment of the present invention. That is, as shown in FIG. 30, the cloth fixing frame is a modification of the cloth fixing frame according to the second embodiment. That is, the hollow portion 4 for coupling the frame pieces 1*a* through 1*d* of the cloth fixing frame of this embodiment provided with a corrugation 80 formed by extrusion-molding as shown in FIG. 30. Further, the corner means 2 is formed by cutting a bandlike plate 81 shown in FIG. 29 is cut to the shape of V as shown in FIG 30. The thickness of the central portion 82 of the bandlike plate 81 in the direction of the width thereof may be made somewhat larger than the remaining portion as shown in FIG. 29(*a*) or one or both surfaces of the central portion 82 of the bandlike plate may be corrugated by extrusion molding as shown in FIG. 29(*b*).

FIG. 30 shows a manner in which a plurality of the corner means 2 can be formed by V-cutting the bandlike plate 81 in the longitudinal direction one by one. In this case, the side surface of the corner means may be tapered so that the width of each of the ends of corner means 2 is gradually smaller than the bent portion thereof as shown in FIG. 30. Further, the thickness of the bandlike plate may be made larger at the central portion thereof in the direction of the width than the remaining portion so that the surface of the plate is gradually tapered toward both sides thereof so that both ends of the corner means 2 are smaller in thickness than the bent portion. The bandlike plate 81 of FIG. 29(*a*) may be cut to the shape of V, too.

Figure 33:
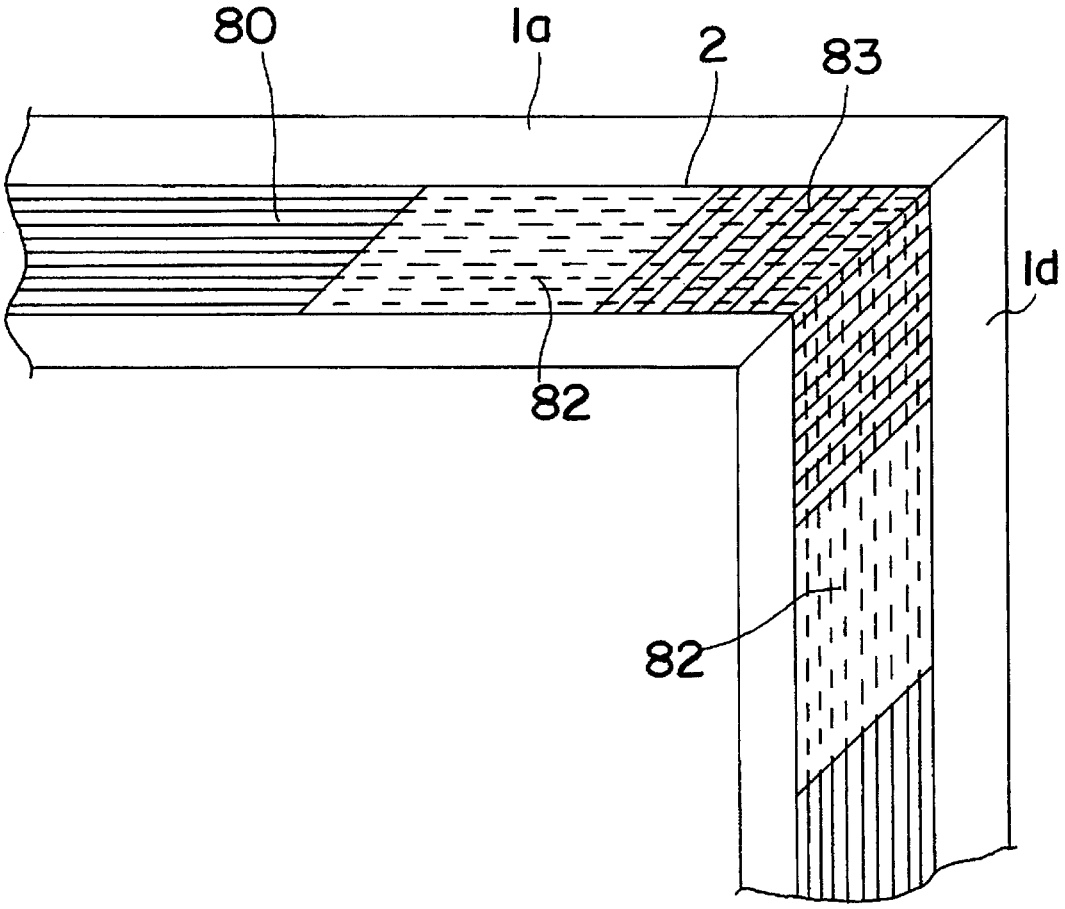
FIG. 33 is a view illustrating a state in which the corner member shown in FIG. 31 is fitted in a joining two frame-pieces of a cloth fixing frame of the present invention.

Referring to FIG. 33, the corner means 2 is fitted in the hollow portion 4 for coupling the horizontal and vertical frame pieces 1*a* and 1*b* of the cloth fixing frame 1. In assembling the frame pieces 1*a* through 1*b*, the corner means 2 are fitted into the respective follow portions 4 of the frame-fitted to form the four corners of the finished frame 1 as the frame-pieces are tapped in their entireties. In this case, the corrugations 83 of the corner means 2 intersect the but these corrugations engage each other in a crushed state. The same thing can be said about the corner means 2 formed by cutting the bandlike plate 81 shown in FIG. 29(*a*) but in this case, the corrugations 80 of the hollow portion 4 are crushed by the central portion 82 of the corner means 2 or where the corner means 2 is made of a material softer than the frame-pieces, the central portion 82 will be crushed.

In this embodiment, it is sufficient that at least either the hollow portion 4 or the corner means 2 be provided with corrugations. Further, although, in this embodiment, the hollow portion 4 and the corner means 2 have corrugations only on both side surfaces thereof, they may have such corrugations on the entire peripheries thereof, respectively. In addition, although the corner means 2 is tapered so that the width thereof becomes gradually smaller from the bent portion toward both ends thereof, the thickness thereof may also be tapered in the same manner.

Figure 34:
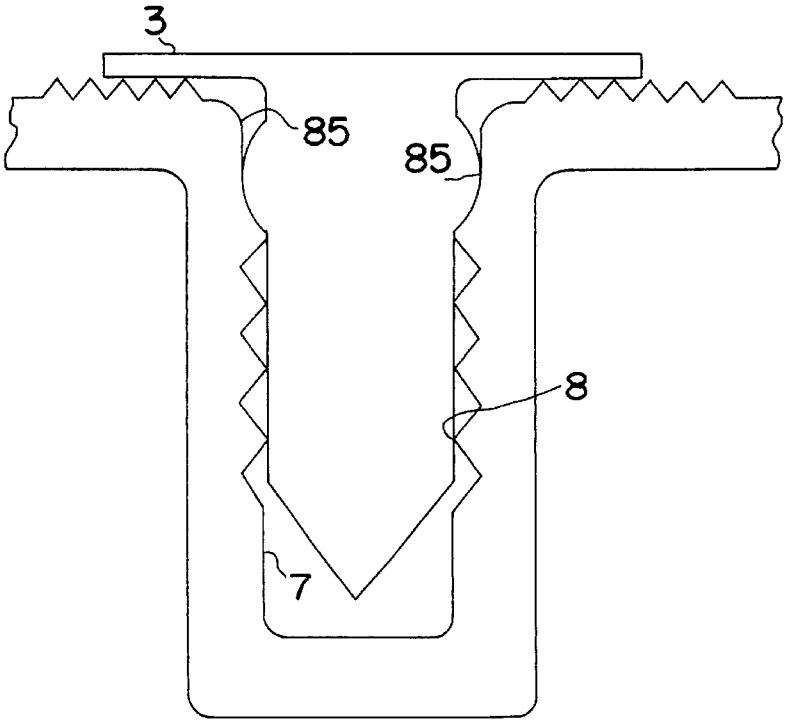
FIG. 34 is a partial sectional view of a ninth embodiment of the present invention.
Figure 35:
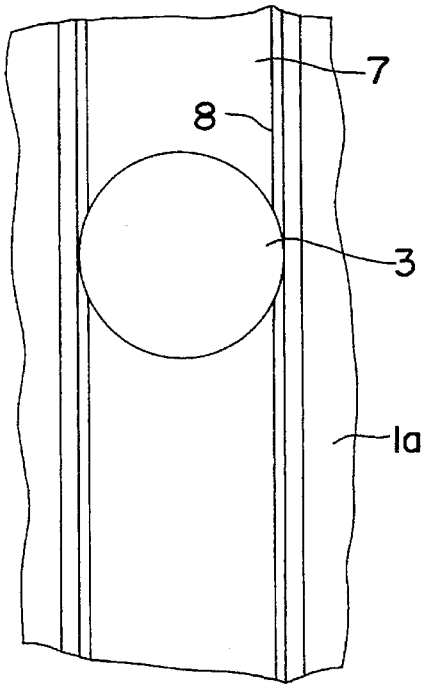
FIG. 35 is a plan view of the same.

FIGS. 34 and 35 show a cloth fixing frame according to a ninth embodiment of the present invention. This embodiment is a modification of the second embodiment of the present invention. For example, in this embodiment, the fixing means 3 is made of aluminum and the cloth fixing frame 1 is made of an aluminum alloy which is harder than aluminum. Further, there are formed chipping receiving sections 85 at the open end of the groove 7 so as to lie adjacent corrugations 8. Thus, when the fixing means 3 is press-fitted into the groove 7, the peripheral surface of the fixing means 3 bites the corrugations 8 as it is abrased by the ridges of the corrugations 8. In this case, the chippings of the fixing means 3 pool in the root portions of the corrugations and chippings produced at the uppermost portion of the groove 7 are received by the chipping receiving sections 85.

Therefore, according to this embodiment, it is possible to prevent chippings from getting accumulated.

Figure 36:
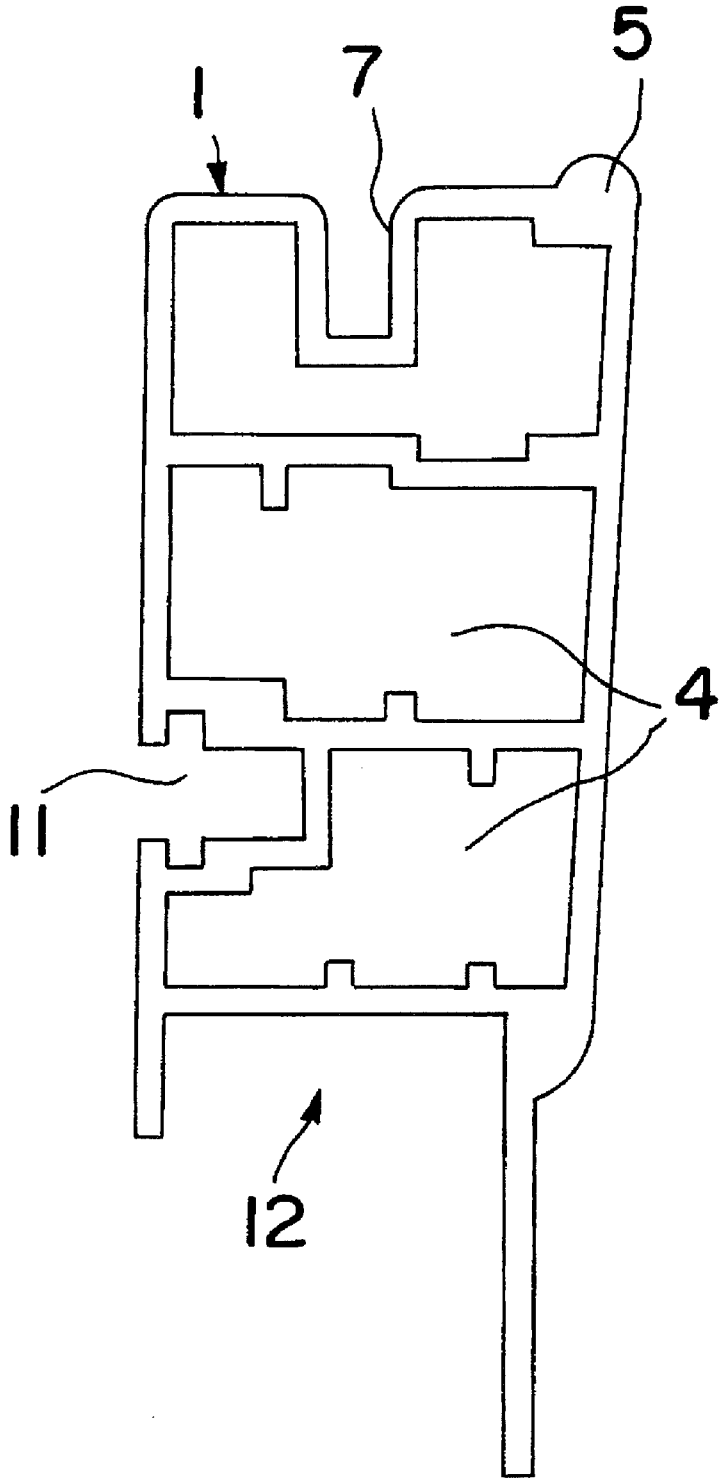
FIG. 36 is a sectional view of an essential portion of a tenth embodiment of the present invention.
Figure 37:
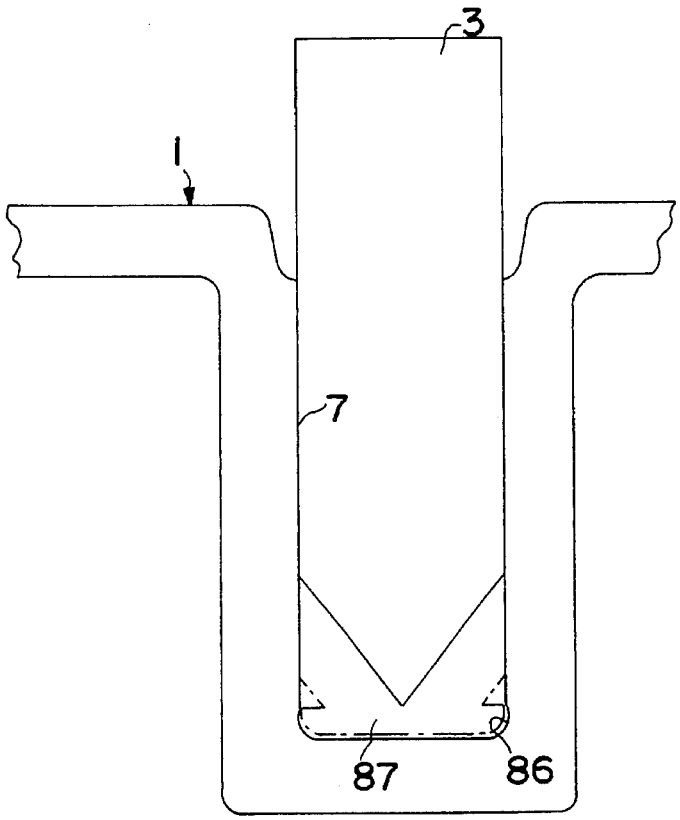
FIG. 37 is a partial sectional view of the same.
Figure 38:
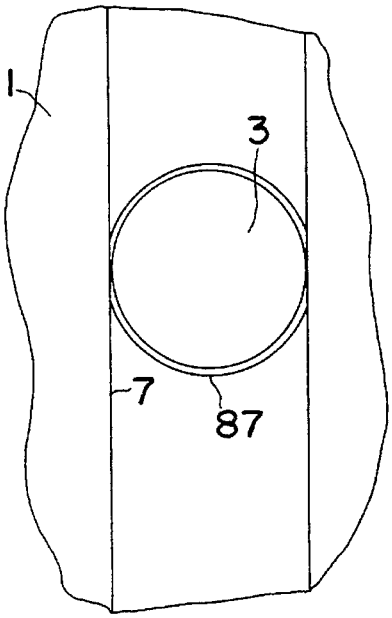
FIG. 38 is a plan view of the same.

FIGS. 36 through 38 show a cloth fixing frame according to a tenth embodiment of the present invent ion. Like the ninth embodiment, the fixing means 3 is made of a material softer than the cloth fixing frame 1 and the groove 7 is provided with a chamfered corner portion 86 at the side surface of the bottom thereof instead of being provided with the corrugations 8 so that when the fixing means 3 is driven into the groove 7 and the top end of the means 3 runs against the bottom surface of the groove 7, a crushed portion 87 enters into, and adhered to, the chamfered corner portion 86. However, even when such corner portion 86 is absent, the fixing means 3 can be fixed to the bottom of the groove 7 with the crushed portion thereof adhering to the bottom of the groove 7.

Figure 39:
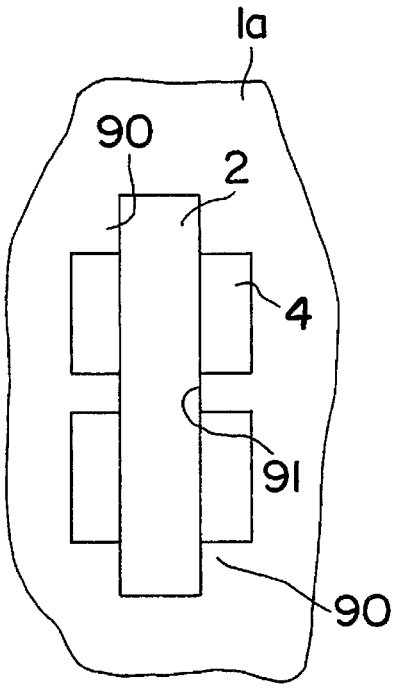
FIG. 39 is a sectional view of one of the frame-pieces of the cloth fixing frame according to the eighth embodiment of the present invention.
Figure 40:
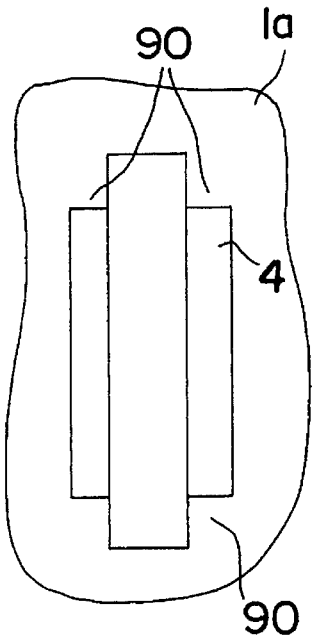
FIG. 40 is a sectional view of a modification of the frame-piece shown in FIG. 39.
Figure 41:
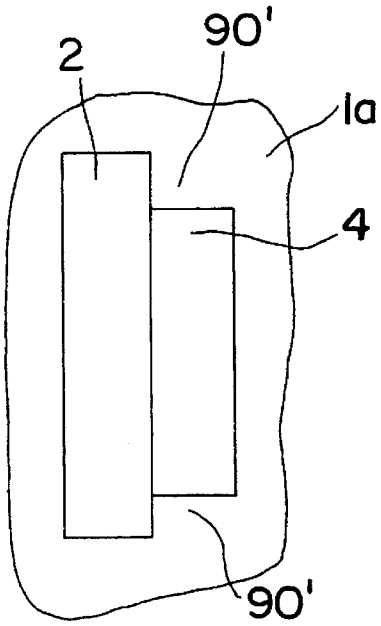
FIG. 41 is a sectional view of another modification of the frame-piece shown in FIG. 39.
Figure 42:
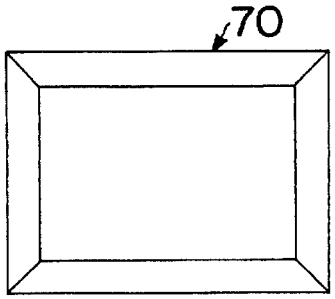
FIG.42 PRIOR ART
FIG. 42 is a perspective view of a conventional cloth fixing frame.
Figure 43:
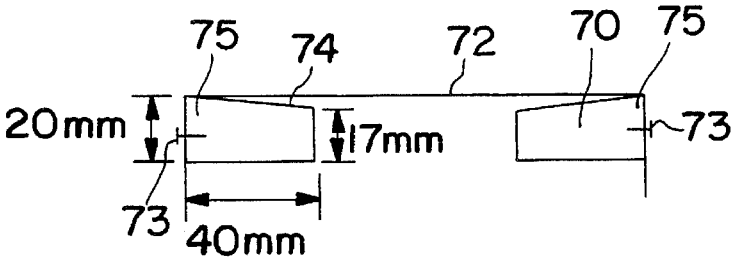
FIG.43 PRIOR ART
FIG. 43 is a schematic partial sectional view of the cloth fixing frame shown in FIG. 42.
Figure 44:
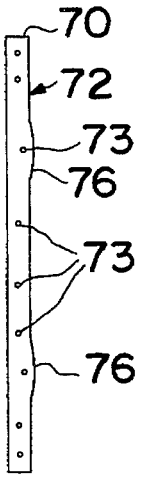
FIG.44 PRIOR ART
FIG. 44 is a side view of a cloth fixing frame.

FIGS. 39 through 41 show modifications of the frame pieces 1*a* through 1*d* of the cloth fixing frame 1 according to the eighth embodiment of the present invention. In any of these modifications, the coupling hollow portion 4 of each of the frame pieces 1*a* through 1*d* is larger than the thickness of the corner member 2. FIG. 39 is a sectional view of the hollow portion 4 in which both ends and the central portion of the hollow portion 4 are made small in width as at 90 and 91 so as to correspond to the thickness of the corner member 2 and at least the surfaces of the portions 90 and 91 are provided with corrugations 80 or the surface of the corner member 2 is provided with a corrugation 83.

The modification shown in FIG. 40 is deviod of the central small width portion 91 of the FIG. 39 modification and the modification shown in FIG. 41 is provided with a small width portion 90' on one of the inner side surfaces of the hollow portion 4 so that one side surface of the corner member 2 comes into contact with the inner side surface of the hollow portion 4. In this case, the corrugations 80 or 83 may be formed in a wider range than in the case of the FIG. 40 embodiment.

Where the thickness of the cloth fixing frame 1 is large, the hollow portion 4 becomes large correspondingly because of extrusion molding, However, this modification has the advantage that since it is not necessary to increase the thickness of the corner means 2 due to the presence of the small width portions 90 and 91, the manufacture of the frame can be made with ease.

What is claimed is:

1. A cloth fixing frame comprising a plurality of extrusion-molded frame-pieces, a plurality of corner members for coupling the frame-pieces together to provide a frame and a plurality of fixing means for fixing a cloth to the frame under tension, wherein:

each of said frame-pieces is provided with a groove extending on and along an outer peripheral end surface thereof over which a cloth extends, a cloth fixing projection portion on a front side and at least a hollow portion into which one end of each of the corner member is fitted, each of said fixing means is provided with a leg for being driven into the groove through the cloth and a head provided on said leg for pressing the cloth against the outer peripheral end surface of each of the frame-pieces, and either an inner wall surface of the hollow portion of each of the frame-piece or an outer surface of said corner members is provided with a crushable portion whereby when said corner means is press fitted into said hollow portion, the crushable portion is crushed.

2. A cloth fixing frame comprising a plurality of extrusion-molded frame-pieces, a plurality of corner members for coupling the frame-pieces together to provide a frame and a plurality of fixing means for fixing a cloth to the frame under tension, wherein:

each of said frame-pieces is provided with a groove extending on and along an outer peripheral end surface thereof over which a cloth extends, a cloth fixing projecting portion on a front side and at least a hollow portion into which one end of each of the corner members is fitted,.

each of said fixing means is provided with a leg for being driven into the groove through the cloth and a head provided on said leg for pressing the cloth against the outer peripheral end surface of each of the frame-pieces, and each of the frame-pieces has a fitting groove on an inner side surface thereof so that at least a reinforcing crosspiece is interposed between each of opposing pairs of the frame-pieces with both ends of the reinforcing crosspiece engaging the fitting grooves of each of the opposing pairs of the frame-pieces, respectively.

3. A cloth fixing frame comprising a plurality of extrusion-molded frame-pieces, a plurality of corner members for coupling together the frame-pieces to form a frame and a plurality of fixing means for fixing a cloth to the frame under tension, wherein:

each of the frame-pieces is provided with a groove extending on and along an outer peripheral end surface thereof over which a cloth extends, a cloth fixing projecting portion on a front side and at least a hollow portion into which one end of each of the corner members is fitted.

each of said fixing means is provided with a leg for being driven into the groove through the cloth and a head provided on said leg for pressing the cloth against the outer peripheral end surface of each of the frame-pieces, and each of said frame-pieces is provided on a rear surface thereof with a picture frame fitting groove whose opposing inner wall surfaces are corrugated so as to allow a screw to be screw-fitted into said groove.

4. A cloth fixing frame comprising a plurality of extrusion-molded frame-pieces, a plurality of corner members for coupling the frame-pieces together to provide a frame and a plurality of fixing means for fixing a cloth to the frame under tension, wherein:

each of the frame-pieces is provided with a groove extending on and along an outer peripheral end surface thereof over which a cloth extends, a cloth fixing projecting portion on a front side and at least a hollow portion into which one end of each of the corner members is fitted, each of said fixing means is provided with a leg for being driven into the groove through the cloth and a head provided on said leg for pressing the cloth against the outer peripheral end surface of each of the frame-pieces, opposing inner wall surfaces of said groove are corrugated so that the leg of each of the fixing means comes into frictional contact with the corrugated inner wall surfaces, and each of said frame-pieces is made of a material harder than said fixing means and chipping receiving sections are formed on opposing inner wall surfaces of the groove of each of the frame-pieces, respectively, whereby chipping from an outer surface of said fixing means generated when said fixing means is press-fitted into said groove are accumulated in said chipping receiving sections.

* * * * *